US009085918B2

(12) United States Patent
Mette

(10) Patent No.: US 9,085,918 B2
(45) Date of Patent: Jul. 21, 2015

(54) STATUS INDICATOR SYSTEM FOR A VEHICLE DOOR LOCK

(71) Applicant: GM GLOBAL TECHNOLOGY OPERATIONS LLC, Detroit, MI (US)

(72) Inventor: Richard K. Mette, Shelby Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 294 days.

(21) Appl. No.: 13/858,998

(22) Filed: Apr. 9, 2013

(65) Prior Publication Data

US 2014/0299045 A1 Oct. 9, 2014

(51) Int. Cl.
*E05B 41/00* (2006.01)
*E05B 85/08* (2014.01)

(52) U.S. Cl.
CPC ..... *E05B 41/00* (2013.01); *E05B 85/08* (2013.01)

(58) Field of Classification Search
CPC ..... E05B 41/00; E05B 85/08; E05B 85/085; B60J 5/00
USPC ..... 116/28 R, 33, 200, 279; 70/432, 441; 180/286
See application file for complete search history.

(56) References Cited

U.S. PATENT DOCUMENTS

| | | | | |
|---|---|---|---|---|
| 2,339,170 | A * | 1/1944 | Jacobs | 70/263 |
| 2,965,402 | A * | 12/1960 | Hollar, Jr. | 292/347 |
| 4,083,589 | A * | 4/1978 | Palmerino | 292/336.3 |
| 6,131,965 | A * | 10/2000 | Trammell, Jr. | 292/1 |
| 7,070,214 | B2 * | 7/2006 | Fisher et al. | 292/216 |
| 2003/0177974 | A1 * | 9/2003 | Dominique | 116/200 |
| 2005/0077733 | A1 * | 4/2005 | Fisher et al. | 292/201 |

FOREIGN PATENT DOCUMENTS

| | | | | |
|---|---|---|---|---|
| AU | 2014100352 | A4 * | 5/2014 | E05B 55/00 |
| DE | 4440717 | C1 * | 2/1996 | E05B 65/38 |
| EP | 1347132 | A1 * | 9/2003 | E05B 65/20 |
| GB | 1437390 | A * | 5/1976 | E05B 85/08 |
| GB | 2090318 | A * | 7/1982 | E05B 3/00 |

* cited by examiner

*Primary Examiner* — R. A. Smith
(74) *Attorney, Agent, or Firm* — Quinn Law Group, PLLC

(57) ABSTRACT

A status indicator system for a vehicle door lock includes a housing defining a cavity therein. The system also includes a cable translatable along a horizontal axis between a first position wherein the lock has an unlocked status, and a second position wherein the lock has a locked status. Further, the system includes a clevis attached to the cable and translatable within the cavity along the horizontal axis as the cable translates between the first and second positions. The system includes an indicator button operatively connected to and translatable within the cavity along a vertical axis perpendicular to the horizontal axis between an unlocked position wherein the indicator button protrudes from the housing when the cable is disposed in the first position, and a locked position wherein the indicator button is recessed into the cavity when the cable is disposed in the second position.

20 Claims, 2 Drawing Sheets

STATUS INDICATOR SYSTEM FOR A VEHICLE DOOR LOCK

TECHNICAL FIELD

The present disclosure relates to a status indicator system for a vehicle door lock.

BACKGROUND

Vehicles, such as automotive vehicles, often include one or more doors each equipped with a door lock. Generally, the door may pivot about an axis to an open position to allow ingress into or egress from a passenger compartment of the vehicle. Conversely, the door may pivot to a closed position and latch to the vehicle to enclose the passenger compartment.

Further, the door lock may transition between a locked status in which the door may not unlatch from the vehicle or pivot to the open position, and an unlocked status in which the door may unlatch from the vehicle and pivot to the open position.

SUMMARY

A status indicator system for a vehicle door lock includes a housing defining a cavity therein, and a cable translatable along a horizontal axis between a first position wherein the vehicle door lock has an unlocked status, and a second position wherein the vehicle door lock has a locked status. The status indicator system also includes a clevis attached to the cable. The clevis is translatable within the cavity along the horizontal axis as the cable translates between the first position and the second position. In addition, the status indicator system includes an indicator button operatively connected to the clevis and translatable within the cavity along a vertical axis that is substantially perpendicular to the horizontal axis. The indicator button translates between an unlocked position wherein the indicator button protrudes from the housing along the vertical axis when the cable is disposed in the first position, and a locked position wherein the indicator button is recessed into the cavity along the vertical axis when the cable is disposed in the second position.

In one embodiment, the housing defines a first channel therein, and the indicator button defines a second channel therein. Further, the clevis has a first end attached to the cable, and a second end spaced apart from the first end. The status indicator system also includes a pin protruding from the second end, disposed substantially perpendicular to the horizontal axis, and translatable within the first channel and the second channel. The indicator button is translatable into the cavity along the vertical axis to thereby push the clevis out of the cavity and the cable along the horizontal axis to the second position. Further, the indicator button is translatable out of the cavity along the vertical axis as the clevis translates into the cavity and the cable translates along the horizontal axis to the first position.

In another embodiment, the second channel has a central longitudinal axis that is neither perpendicular nor parallel to the horizontal axis, and is neither perpendicular nor parallel to the vertical axis. Further, the status indicator system includes a bezel surrounding the indicator button, and a trim layer sandwiched between the bezel and the housing.

The above features and advantages and other features and advantages of the present invention will be readily apparent from the following detailed description of the preferred embodiments and best modes for carrying out the present invention when taken in connection with the accompanying drawings and appended claims.

DETAILED DESCRIPTION

Figure 1:
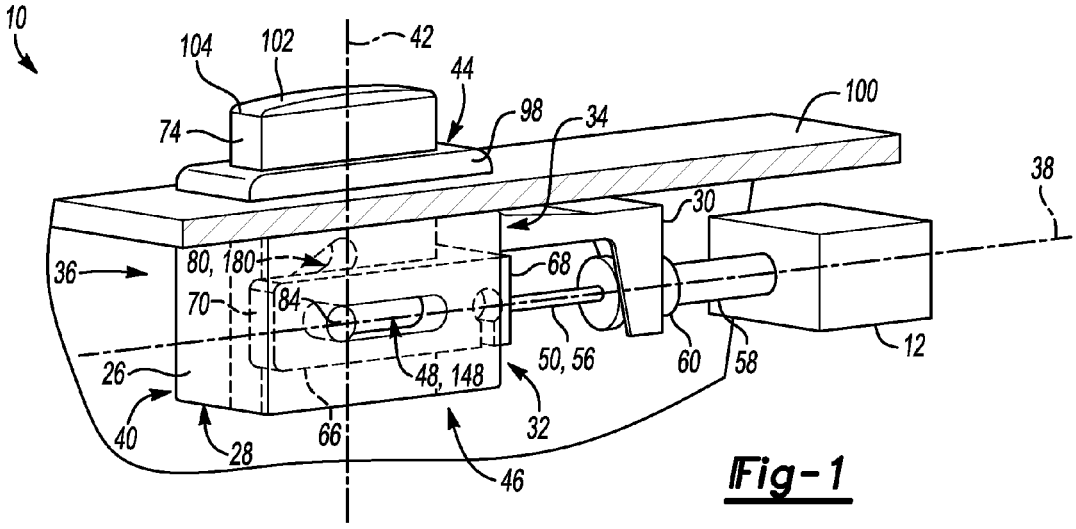
FIG. 1 is a schematic perspective illustration of a partial cross-sectional view of a status indicator system for a vehicle door lock.

Referring to the Figures, wherein like reference numerals refer to like elements, a status indicator system 10 for a vehicle door lock 12 is shown generally in FIG. 1. The status indicator system 10 may be useful for vehicles 14 (FIG. 5), such as automotive vehicles, that have one or more doors 16 (FIG. 5) each configured for providing ingress into and egress from a passenger compartment 18 (FIG. 5) of the vehicle 14. One or more of the doors 16 may include the vehicle door lock 12, and the vehicle door lock 12 may prevent entry into the passenger compartment 18 when desired. For example, although illustrated generally in FIGS. 1-3, the vehicle door lock 12 may transition between an unlocked status (represented at 20 in FIG. 2) and a locked status (represented at 22 in FIG. 3), to respectively allow and prevent entry into the passenger compartment 18.

Figure 5:
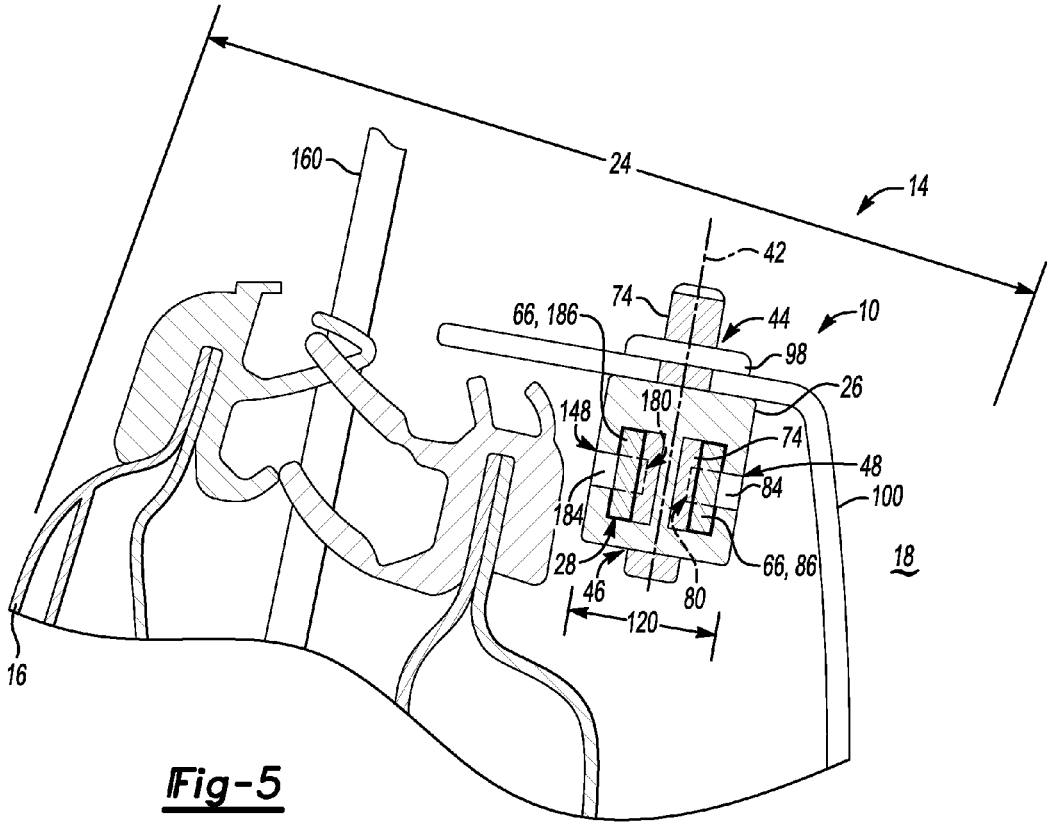
FIG. 5 is a schematic illustration of a cross-sectional view of a vehicle door including the status indicator system of FIGS. 1-4.

In particular, with continued reference to FIG. 5, the status indicator system 10 may be useful for vehicles 14 requiring a spacious passenger compartment 18, since the status indicator system 10 allows for vehicle doors 16 having a reduced overall thickness 24. As such, the status indicator system 10 may also be useful for non-automotive applications including, for example, industrial vehicle and recreational vehicle applications. More specifically, when assembled into the vehicle 14, the status indicator system 10 may be spaced opposite a vehicle window 160 along a trim layer 100 so that a vehicle operator may visually detect the unlocked or locked status 20, 22 (FIGS. 2 and 3) of the vehicle door lock 12, and yet may be sufficiently compact to ensure the reduced overall thickness 24 of the door 16. In particular, the status indicator system 10 may be free from any actuator rod (not shown) extending vertically from the status indicator system 10 towards a road surface (not shown), and disposed parallel to the vehicle window 160 that may be configured for actuating the vehicle door lock 12. Therefore, the status indicator system 10 may allow for minimal clearance between the vehicle window 160 and the trim layer 100 and thereby reduce the overall thickness 24 of the door 16.

Referring again to FIG. 1, the status indicator system 10 includes a housing 26 defining a cavity 28 therein. Further, the housing 26 may have a generally rectangular shape, and may include an appendage 30 extending toward the vehicle door lock 12. More specifically, the housing 26 may have a proximal end 32 having an upper portion 34, and a distal end 36 spaced apart from the proximal end 32 along a horizontal axis 38. Further, the distal end 36 may have a lower portion 40 spaced apart from the upper portion 34 along a vertical axis 42 that is substantially perpendicular to the horizontal axis 38. In addition, the housing 26 may define an upper opening 44 and a lower opening 46 spaced apart from the upper opening 44 along the vertical axis 42.

Moreover, with continued reference to FIG. 1 and as set forth in more detail below, the housing 26 may define a first channel 48 therein. Further, as best shown in FIG. 5, the housing 26 may define a plurality of first channels 48, 148 therein, each defined by opposite sides of the housing 26. The housing 26 may be formed from any suitable material, such as, but not limited to, a metal, plastic, or composite. In one non-limiting example, the housing 26 may have a length 110 (FIG. 2) of from about 25 mm to about 35 mm, e.g., about 30 mm, a width 120 (FIG. 5) of from about 10 mm to about 20 mm, e.g., about 15 mm, and a height 130 (FIG. 2) of from about 12 mm to about 22 mm, e.g., about 17 mm. As such, the housing 26 may be compact and allow for placement along any portion of the door 16 (FIG. 5).

With continued reference to FIG. 1, the status indicator system 10 also includes a cable 50 translatable along the horizontal axis 38 between a first position (indicated generally at 52 in FIG. 2) wherein the vehicle door lock 12 has the unlocked status 20, i.e., is unlocked, and a second position (indicated generally at 54 in FIG. 3) wherein the vehicle door lock 12 has the locked status 22, i.e., is locked. As such, the cable 50 may be rigid, and may include, for example, a solid core 56 extendible within a conduit 58. Further, the cable 50 may extend through a nut 60 disposed on the appendage 30 of the housing 26, and may include a barrel end fitting 62 (FIG. 4) disposed at one end 64 of the cable 50.

Figure 4:
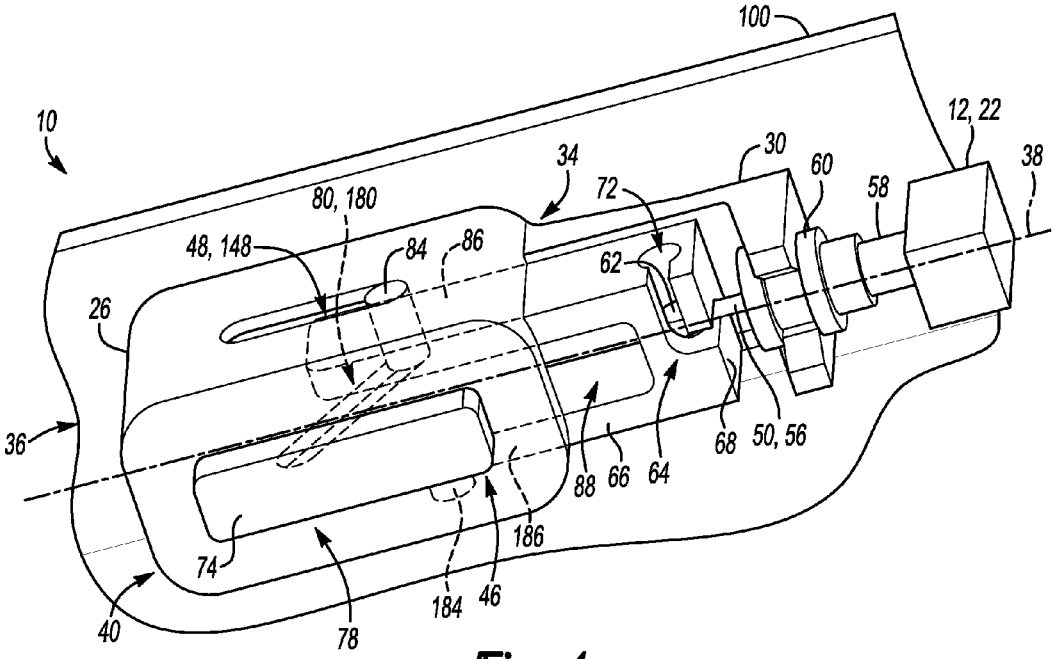
FIG. 4 is a schematic perspective illustration of a bottom view of the status indicator system of FIG. 3.

Referring again to FIG. 1, the status indicator system 10 further includes a clevis 66 attached to the cable 50. For example, the clevis 66 may have a first end 68 attached to the cable 50 and a second end 70 spaced apart from the first end 68. As best shown in FIG. 4, the clevis 66 may define a keyhole 72 at the first end 68 configured for receiving and retaining the barrel end fitting 62 of the cable 50 to thereby attach the cable 50 to the clevis 66.

Figure 2:
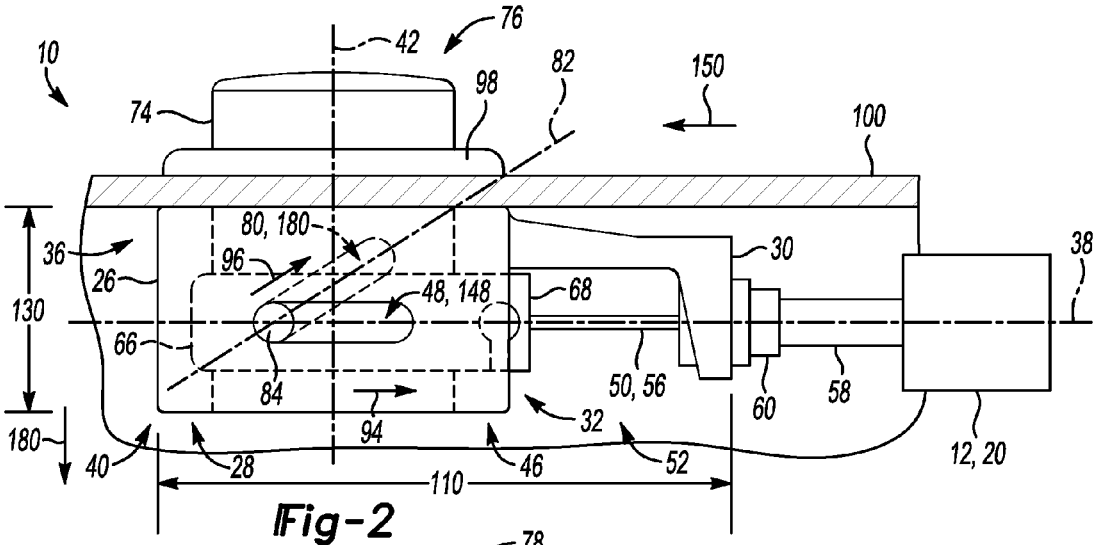
FIG. 2 is a schematic illustration of a side, partially cross-sectional view of the status indicator system of FIG. 1, wherein an indicator button is disposed in an unlocked position.
Figure 3:
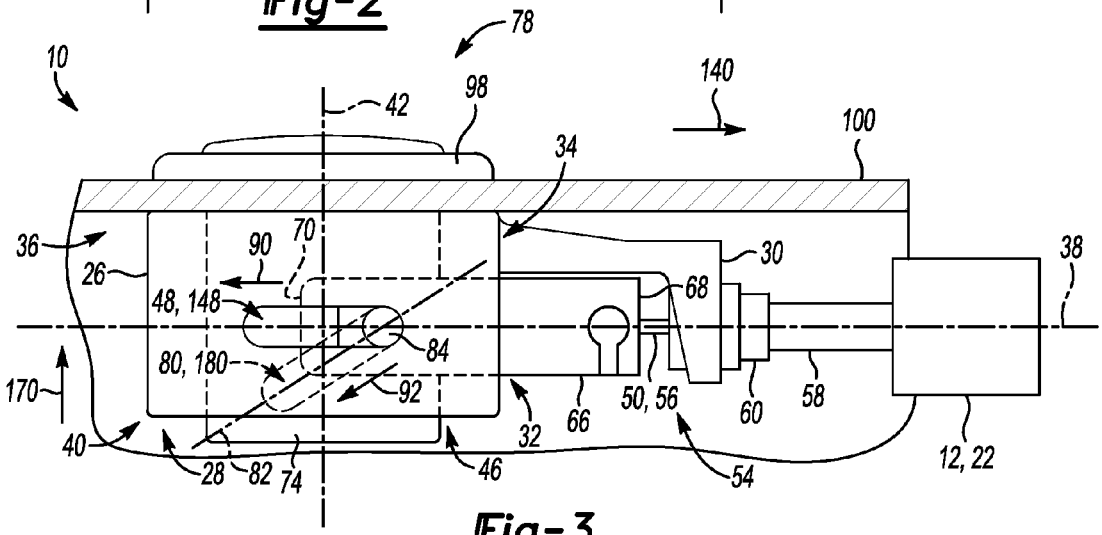
FIG. 3 is a schematic illustration of a side, partially cross-sectional view of the status indicator system of FIGS. 1 and 2, wherein the indicator button is disposed in a locked position.

Referring now to FIGS. 2 and 3, in operation and as set forth in more detail below, the clevis 66 is translatable within the cavity 28 along the horizontal axis 38 as the cable 50 translates between the first position 52 (FIG. 2) and the second position 54 (FIG. 3). That is, the clevis 66 may alternately translate into and out of the cavity 28, and towards and away from the proximal end 32 of the housing 26 along the horizontal axis 38.

In addition, as shown in FIG. 1, the status indicator system 10 also includes an indicator button 74 operatively connected to the clevis 66 and translatable within the cavity 28 along the vertical axis 42 between an unlocked position 76 (FIG. 2) wherein the indicator button 74 protrudes from the housing 26 along the vertical axis 42 when the cable 50 is disposed in the first position 52 (FIG. 2), and a locked position 78 (FIG. 3) wherein the indicator button 74 is recessed into the cavity 28 along the vertical axis 42 when the cable 50 is disposed in the second position 54 (FIG. 3). That is, the indicator button 74 may protrude from the cavity 28 when the vehicle door lock 12 has the unlocked status 20, i.e., is unlocked. Therefore, the indicator button 74 may be formed from a material, such as plastic, having a bright color, e.g., red or orange, so as to alert the vehicle operator as to the unlocked status 20 of the vehicle door lock 12 when the indicator button 74 protrudes from the cavity 28.

As further described with reference to FIG. 3, the indicator button 74 may be translatable into the cavity 28 along the vertical axis 42 to thereby push the clevis 66 out of the cavity 28 and the cable 50 along the horizontal axis 38 to the second position 54, e.g., in the direction of arrow 140. As such, as set forth in more detail below and shown in FIG. 3, the indicator button 74 may protrude from the lower opening 46 when the cable 50 is disposed in the second position 54. Conversely, as described with reference to FIG. 2, the indicator button 74 may be translatable out of the cavity 28 along the vertical axis 42 as the clevis 66 translates into the cavity 28 and the cable 50 translates along the horizontal axis 38 to the first position 52, e.g., in the direction of arrow 150.

More specifically, with continued reference to FIGS. 2 and 3, the indicator button 74 may define a second channel 80 therein. In one example, the indicator button 74 may define the second channel 80 therethrough. However, as best shown in FIG. 5, the indicator button 74 may alternatively define a plurality of second channels 80, 180 therein each defined by opposite surfaces of the indicator button 74. The second channel 80 may be sloped with respect to the horizontal axis 38. That is, the second channel 80 may have a central longitudinal axis 82 that is neither perpendicular nor parallel to the horizontal axis 38, and is neither perpendicular nor parallel to the vertical axis 42. Rather, the second channel 80 may slope upwards from the lower portion 40 of the distal end 36 of the housing 26 towards the upper portion 34 of the proximal end 32.

Referring again to FIG. 1, the status indicator system 10 may further include a pin 84 protruding from the second end 70 of the clevis 66. The pin 84 may be disposed substantially perpendicular to the horizontal axis 38, and may be translatable within the first channel 48 and the second channel 80. That is, as assembled, the pin 84 may rest within the first channel 48 and the second channel 80. Further, as best shown in FIG. 5, the status indicator system 10 may include a plurality of pins 84, 184 that may be disposed within a respective one of the plurality of first channels 48, 148 and the plurality of second channels 80, 180.

That is, as best shown in FIG. 4, the clevis 66 may be substantially U-shaped, may include two legs 86, 186, and may define an aperture 88 configured for receiving the indicator button 74 as the clevis 66 translates along the horizontal axis 38. As such, one of the plurality of pins 84, 184 may extend from each of the two legs 86, 186 and be disposed within a respective one of the plurality of first channels 48, 148 and within a respective one of the plurality of second channels 80, 180.

Therefore, referring to FIGS. 2 and 3, the indicator button 74 may be translatable into and out of the cavity 28 along the vertical axis 42 to simultaneously translate the pin 84 within the first channel 48 along the horizontal axis 38. Likewise, the indicator button 74 may be translatable into and out of the cavity 28 along the vertical axis 42 to simultaneously translate the pin 84 within the second channel 80. Stated differently, the indicator button 74 may be translatable into and out of the cavity 28 along the vertical axis 42 to simultaneously translate the pin 84 within the first channel 48 and the second channel 80.

More specifically, referring to FIG. 3, in operation, the indicator button 74 may be translatable out of the cavity 28 as the pin 84 translates in a first direction 90 within the first channel 48 and in a second direction 92 within the second channel 80 to eventually dispose the indicator button 74 in the unlocked position 76 (FIG. 2). That is, to unlock the vehicle door lock 12, a latch lever (not shown) of the vehicle door lock 12 may push on the cable 50 to translate the cable 50 in the direction of arrow 150 (FIG. 2) so that the clevis 66 also translates along the horizontal axis 38 in the first direction 90

(FIG. 3), which may in turn slide the pin 84 in the second direction 92 along the second channel 80 so that the indicator button 74 slides in an upward direction 170 (FIG. 3) and protrudes from the cavity 28 and housing 26 as shown in FIG. 2. Stated differently, the indicator button 74 may be translatable out of the cavity 28 as the clevis 66 translates into the cavity 28 and the pin 84 translates towards the distal end 36 within the first channel 48, and along the central longitudinal axis 82 towards the lower portion 40 within the second channel 80.

Conversely, referring again to FIG. 2, the indicator button 74 may be translatable into the cavity 28, i.e., in a downward direction 180, to thereby translate the pin 84 in a third direction 94 within the first channel 48 that is opposite the first direction 90 (FIG. 3), and in a fourth direction 96 within the second channel 80 that is opposite the second direction 92 (FIG. 3). Stated differently, referring to FIG. 3, the indicator button 74 may be translatable into the cavity 28, i.e., in the downward direction 180, to thereby translate the pin 84 towards the proximal end 32 within the first channel 48, and along the central longitudinal axis 82 towards the upper portion 34 within the second channel 80. For example, the indicator button 74 may translate along the vertical axis 42 for from about 2 mm to about 8 mm as the cable 50 translates from the first position 52 (FIG. 2) to the second position 54 (FIG. 3). As a non-limiting example, the cable 50 may translate along the horizontal axis 38 for from about 5 mm to about 15 mm as the indicator button 74 translates from the unlocked position 76 (FIG. 2) to the locked position 78 (FIG. 3).

Referring again to FIG. 1, the status indicator system 10 may further include a bezel 98 surrounding the indicator button 74, and the trim layer 100 sandwiched between the bezel 98 and the housing 26. For example, the bezel 98 may snap onto the trim layer 100 and surround the indicator button 74. The trim layer 100 may be visible to the vehicle operator from an interior of the passenger compartment 18 (FIG. 5). In addition, the status indicator system 10 may also include a cap 102 (FIG. 1) attached to a top 104 (FIG. 1) of the indicator button 74 via, for example, an interference fit.

The aforementioned status indicator system 10 may be placed in any position along the trim layer 100, according to vehicle styling and clearance requirements. For example, the status indicator system 10 may be placed near a B-pillar (not shown) for a rear door 16 (FIG. 5), or may be placed near an A-pillar (not shown) for a front door 16. As such, the status indicator system 10 may enable unique passenger compartment styling and minimize the required overall thickness 24 (FIG. 5) of the door 16. That is, since the clevis 66 and cable 50 translate along the horizontal axis 38 rather than the vertical axis 42 during operation of the status indicator system 10, the status indicator system 10 is free from the aforementioned actuator rod (not shown) that may otherwise travel along the vertical axis 42 to actuate the vehicle door lock 12. Such actuator rods often require additional clearance between the trim layer 100 and an exterior of the door 16, and may therefore limit styling options and component placement within the passenger compartment 18. In contrast, the status indicator system 10 allows for molded-in armrests, unique audio components, and a comparatively larger passenger compartment 18.

That is, the status indicator system 10 is comparatively smaller than other packaging used to indicate lock status, is economical to manufacture through the use of a common housing 26 for multiple types of vehicles 14, is simple to assemble in the vehicle 14, and provides excellent shoulder-, elbow-, and arm-clearance within the passenger compartment 18. Further, a color and/or shape of the bezel 98, cap 102 (FIG. 1), and/or trim layer 100 may be matched to one another or to an appearance package of the vehicle 14. Moreover, since the indicator button 74 may recess into the cavity 28 when the indicator button 74 is disposed in the locked position 78, the status indicator system 10 may be disposed flush so as to provide an armrest surface.

In addition, the status indicator system 10 may be free from electronics and/or light emitting diode (LED) lights, and as such, is reliable and may function even when electrical power is disrupted or unavailable for the vehicle 14 (FIG. 5). For example, if a battery (not shown) of the vehicle 14 is without a stored charge, the vehicle door lock 12 may be manually locked by pushing against the indicator button 74 to thereby translate the cable 50 to the second position 54 (FIG. 3). Therefore, the status indicator system 10 provides a quick, accurate, visual indicator of the unlocked status 20 (FIG. 2) or locked status 22 (FIG. 3) of the vehicle door lock 12.

While the best modes for carrying out the present invention have been described in detail, those familiar with the art to which this invention relates will recognize various alternative designs and embodiments for practicing the invention within the scope of the appended claims.

The invention claimed is:

1. A status indicator system for a vehicle door lock, the status indicator system comprising:

a housing defining a cavity therein;

a cable translatable along a horizontal axis between a first position wherein the vehicle door lock has an unlocked status, and a second position wherein the vehicle door lock has a locked status;

a clevis attached to the cable, wherein the clevis is translatable within the cavity along the horizontal axis as the cable translates between the first position and the second position; and an indicator button operatively connected to the clevis and translatable within the cavity along a vertical axis that is substantially perpendicular to the horizontal axis between:

an unlocked position wherein the indicator button protrudes from the housing along the vertical axis when the cable is disposed in the first position; and a locked position wherein the indicator button is recessed into the cavity along the vertical axis when the cable is disposed in the second position.

2. The status indicator system of claim 1, wherein the indicator button is translatable into the cavity along the vertical axis to thereby push the clevis out of the cavity and the cable along the horizontal axis to the second position.

3. The status indicator system of claim 1, wherein the indicator button is translatable out of the cavity along the vertical axis as the clevis translates into the cavity and the cable translates along the horizontal axis to the first position.

4. The status indicator system of claim 1, wherein the housing defines a first channel therein and the indicator button defines a second channel therein.

5. The status indicator system of claim 4, wherein the clevis has a first end and a second end spaced apart from the first end, and wherein the status indicator system further includes a pin protruding from the second end, disposed substantially perpendicular to the horizontal axis, and translatable within the first channel and the second channel.

6. The status indicator system of claim 5, wherein the indicator button is translatable into and out of the cavity along the vertical axis to simultaneously translate the pin within the first channel along the horizontal axis.

7. The status indicator system of claim 5, wherein the indicator button is translatable into and out of the cavity along the vertical axis to simultaneously translate the pin within the second channel.

8. The status indicator system of claim 5, wherein the indicator button is translatable into and out of the cavity along the vertical axis to simultaneously translate the pin within the first channel and the second channel.

9. The status indicator system of claim 4, wherein the second channel has a central longitudinal axis that is neither perpendicular nor parallel to the horizontal axis, and is neither perpendicular nor parallel to the vertical axis.

10. The status indicator system of claim 9, wherein the indicator button is translatable out of the cavity as the pin translates in a first direction within the first channel, and in a second direction within the second channel.

11. The status indicator system of claim 10, wherein the indicator button is translatable into the cavity to thereby translate the pin in a third direction within the first channel that is opposite the first direction, and in a fourth direction within the second channel that is opposite the second direction.

12. The status indicator system of claim 1, wherein the housing defines an upper opening and a lower opening spaced apart from the upper opening along the vertical axis.

13. The status indicator system of claim 12, wherein the indicator button protrudes from the lower opening when the cable is disposed in the second position.

14. The status indicator system of claim 1, wherein the clevis is substantially U-shaped and defines an aperture configured for receiving the indicator button as the clevis translates along the horizontal axis.

15. The status indicator system of claim 1, further including:

a bezel surrounding the indicator button; and a trim layer sandwiched between the bezel and the housing.

16. A status indicator system for a vehicle door lock, the status indicator system comprising:

a housing defining a cavity and a first channel therein;

a cable translatable along a horizontal axis between a first position wherein the vehicle door lock has an unlocked status, and a second position wherein the vehicle door lock has a locked status;

a clevis having a first end attached to the cable and a second end spaced apart from the first end, wherein the clevis is translatable within the cavity along the horizontal axis as the cable translates between the first position and the second position;

an indicator button defining a second channel therein, and operatively connected to the clevis and translatable within the cavity along a vertical axis that is substantially perpendicular to the horizontal axis between:

an unlocked position wherein the indicator button protrudes from the housing along the vertical axis when the cable is disposed in the first position; and a locked position wherein the indicator button is recessed into the cavity along the vertical axis when the cable is disposed in the second position; and a pin protruding from the second end, disposed substantially perpendicular to the horizontal axis, and translatable within the first channel and the second channel;

wherein the indicator button is translatable into the cavity along the vertical axis to thereby push the clevis out of the cavity and the cable along the horizontal axis to the second position;

wherein the indicator button is translatable out of the cavity along the vertical axis as the clevis translates into the cavity and the cable translates along the horizontal axis to the first position.

17. The status indicator system of claim 16, wherein the indicator button is translatable into and out of the cavity along the vertical axis to simultaneously translate the pin within the first channel and the second channel.

18. A status indicator system for a vehicle door lock, the status indicator system comprising:

a housing defining a cavity and a first channel therein;

a cable translatable along a horizontal axis between a first position wherein the vehicle door lock has an unlocked status, and a second position wherein the vehicle door lock has a locked status;

a clevis having a first end attached to the cable and a second end spaced apart from the first end, wherein the clevis is translatable within the cavity along the horizontal axis as the cable translates between the first position and the second position;

an indicator button operatively connected to the clevis and translatable within the cavity along a vertical axis that is substantially perpendicular to the horizontal axis between:

an unlocked position wherein the indicator button protrudes from the housing along the vertical axis when the cable is disposed in the first position; and a locked position wherein the indicator button is recessed into the cavity along the vertical axis when the cable is disposed in the second position;

wherein the indicator button defines a second channel therein having a central longitudinal axis that is neither perpendicular nor parallel to the horizontal axis, and is neither perpendicular nor parallel to the vertical axis; and a pin protruding from the second end, disposed substantially perpendicular to the horizontal axis, and translatable within the first channel and the second channel;

a bezel surrounding the indicator button; and a trim layer sandwiched between the bezel and the housing;

wherein the indicator button is translatable into the cavity along the vertical axis to thereby push the clevis out of the cavity and the cable along the horizontal axis to the second position;

wherein the indicator button is translatable out of the cavity along the vertical axis as the clevis translates into the cavity and the cable translates along the horizontal axis to the first position.

19. The status indicator system of claim 18, wherein the housing has:

a proximal end having an upper portion; and a distal end spaced apart from the proximal end along the horizontal axis, and having a lower portion spaced apart from the upper portion; and further wherein the indicator button is translatable into the cavity to thereby translate the pin towards the proximal end within the first channel, and along the central longitudinal axis towards the upper portion within the second channel.

20. The status indicator system of claim 19, wherein the indicator button is translatable out of the cavity as the clevis translates into the cavity and the pin translates towards the distal end within the first channel, and along the central longitudinal axis towards the lower portion within the second channel.

* * * * *